US008798774B2

(12) United States Patent
Mori et al.

(10) Patent No.: US 8,798,774 B2
(45) Date of Patent: Aug. 5, 2014

(54) HOT-WATER SUPPLY SYSTEM

(75) Inventors: Hiroaki Mori, Nagoya (JP); Yukihiro Suzuki, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 357 days.

(21) Appl. No.: 13/213,231

(22) Filed: Aug. 19, 2011

(65) Prior Publication Data

US 2012/0046801 A1 Feb. 23, 2012

(30) Foreign Application Priority Data

Aug. 19, 2010 (JP) ..... 2010-183679

(51) Int. Cl.
*G05B 19/18* (2006.01)

(52) U.S. Cl.
USPC ..... 700/3; 700/300

(58) Field of Classification Search
USPC ..... 700/3, 14, 300; 340/3.52, 3.53, 3.54
See application file for complete search history.

(56) References Cited

U.S. PATENT DOCUMENTS 7,529,593 B2 * 5/2009 Kitagawa et al. ..... 700/3
7,587,465 B1 * 9/2009 Muchow ..... 709/209

FOREIGN PATENT DOCUMENTS

JP 2002-357361 12/2002
JP 2003-222399 8/2003

* cited by examiner

*Primary Examiner* — Sean Shechtman
*Assistant Examiner* — Chad Rapp
(74) *Attorney, Agent, or Firm* — Rankin, Hill & Clark LLP

(57) ABSTRACT

Each of the water heaters 1 performs a master and slave setting process that transmits prescribed response data to the other water heaters 1 via a communication line 8 at a timing according to its own identification number and different from those of the other water heaters in a prescribed master and slave setting time period, that sets the water heater itself to slave in a case of receiving the response data from another water heater 1 assigned with an identification number having a priority higher than its own identification number in the master and slave setting time period, and that sets the water heater itself to master in a case of not receiving the response data from another water heater assigned with an identification number having a priority higher than its own identification number in the master and slave setting time period.

5 Claims, 4 Drawing Sheets

HOT-WATER SUPPLY SYSTEM

BACKGROUND OF THE INVENTION

1. Field of the Invention

The present invention relates to a hot water supply system that cooperatively operates a plurality of water heaters.

2. Description of the Related Art

Conventionally, a hot water supply system has been known in which control units of water heaters are connected to one combining unit and this unit increases and decreases the number of water heaters in operation according to water supply flow rates detected by flow rate sensors included in the respective water heaters in operation (e.g. Japanese Patent Laid-Open No. 2002-357361).

Further, a hot water supply system has been known in which two water heaters are connected to each other without use of a combining unit in a communicable manner, one of the water heaters set to master and the other is set to slave, and, in a case where the master water heater is independently operated, if it is detected that hot water supply capacity is insufficient, the slave water heater is further operated (see e.g. Japanese Patent Laid-Open No. 2003-222399).

According to the hot water supply system described in Japanese Patent Laid-Open No. 2003-222399, in case of failure of one of the master and the slave, the system continues operation of the other water heater that is not in failure.

The hot water supply system described in Japanese Patent Laid-Open No. 2003-222399 switches the master and the slave with each other by means of presence or absence of a short circuit of connector terminals (14*e* and 14*f* or 15*e* and 15*f*) of the respective water heaters. In case of failure of any one of the water heaters, the system independently operates the water heater that is not in failure.

In a case where water heaters are cooperatively operated while one of the water heaters functions as a master and the other functions as a slave, if the number of the water heaters is two, in case of failure of the master water heater, it suffice to independently operate the one water heater that is not in failure. The relationship between the master and the slave is insignificant.

However, in a case where at least three water heaters are cooperatively operated while one of the water heaters functions as a master and the others function as slaves, in case of failure of the master water heater, an operation is required to repair the master water heater in failure or to cause a short circuit at a connector terminal of any of the slave water heaters and switch the heater to master. Accordingly, either case has an inconvenience that cooperative operation is incapable until such measures are taken.

In a case of adopting specifications that includes a remote control for remotely operating a hot water supply system and sets operation conditions, such as a hot water supply temperature, by means of communication between the master water heater and the remote control, if the master water heater fails and communication between the master water heater and the remote control becomes incapable, an inconvenience that the hot water supply system cannot remotely be operated by means of the remote control occurs.

The present invention is made in view of the background. It is an object of the present invention to provide a hot water supply system that can solve various inconveniences caused by failure of a master water heater in a case of cooperatively operating a plurality of water heaters while one of the water heaters functions as the master and the other functions as a slave.

SUMMARY OF THE INVENTION

The present invention is made in order to attain the object, and relates to a hot water supply system that sets one of a plurality of water heaters to master, sets another to slave and cooperatively operates a hot water supply operation.

The hot water supply system comprises: an identification number assigning unit which individually assigns an identification number specifying order of priority, to each of the water heaters; and a mutual communication unit which allows the water heaters to communicate with each other, wherein each of the water heaters performs a master and slave setting process that transmits prescribed response data to the other water heater via the mutual communication unit at a timing according to its own identification number and different from that of the other water heater in a prescribed master and slave setting time period, that sets the water heater itself to slave in a case of receiving the response data from another water heater assigned with an identification number having a priority higher than its own identification number in the master and slave setting time period, and that sets the water heater itself to master in a case of not receiving the response data from another water heater assigned with an identification number having a priority higher than its own identification number in the master and slave setting time period (first aspect).

In the first aspect, according to the master and slave setting process, a water heater assigned with an identification number with the highest priority among the water heaters capable of communicating each other via the mutual communication unit can be set to master, and the other water heaters can be set to slave. Accordingly, even in case where the water heater set to master fails and becomes incapable of communicating with the other water heaters via the mutual communication unit, the master and slave setting process is performed and another water heater is newly set to master, thereby allowing the hot water supply operation to be continued.

The system further comprises a remote control which is capable of communicating with each of the water heaters via the mutual communication unit, and remotely operates the water heater set to master by means of communication via the mutual communication unit (second aspect).

In the second aspect, even in case where the water heater set to master fails and the remote control becomes incapable of remotely controlling the water heater in failure, the master and slave setting process is performed and thereby the water heater newly set to master can be remotely operated by the remote control.

Each of the water heaters receives operation condition data of the hot water supply operation transmitted from the remote control via the mutual communication unit and stores the data in a storing unit included in each of the water heaters, and the water heater set to master performs the hot water supply operation using the operation condition data held in its own storing unit (third aspect).

Each of the water heaters comprises a storing unit which holds operation condition data of the hot water supply operation, and the water heater set to master performs the hot water supply operation using the operation condition data held in its own storing unit (fourth aspect).

In third and fourth aspects, even in a case of changing the water heater set to master, the water heater newly set to master can take over operation conditions of the hot water supply operation from the water heater having previously been set to master, through use of the operation condition data held in the storing unit of the new master water heater.

DETAILED DESCRIPTION OF THE PREFERRED EMBODIMENT

Figure 1:
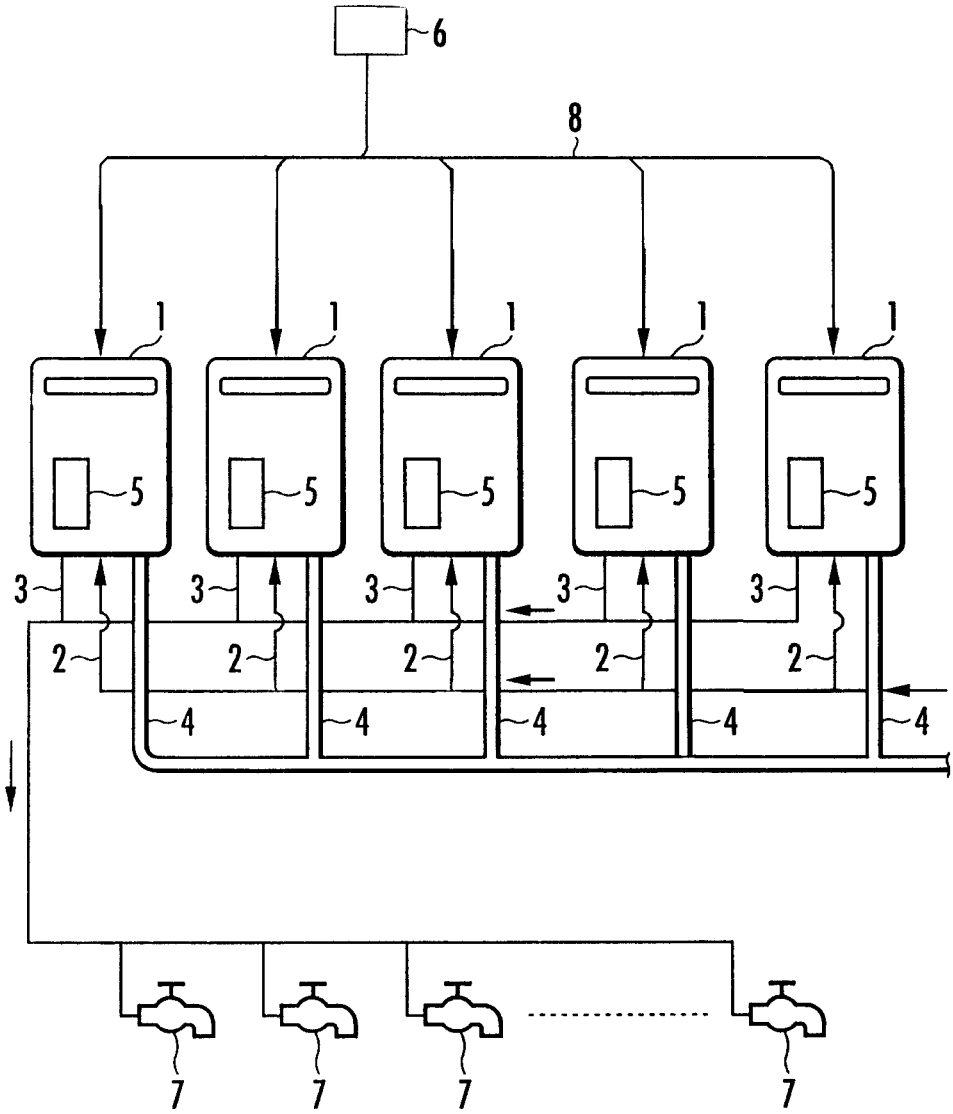
FIG. 1 is a diagram of a configuration of a hot water supply system.

An embodiment of the present invention will be described with reference to FIGS. 1 to 4. Referring to FIG. 1, a hot water supply system of this embodiment includes five water heaters 1 and a remote control 6, which are connected to each other by a communication line 8 (e.g. a nonpolar two-wire cable) in a communicable manner.

Each water heater 1 comprises a burner communicating with a gas supply pipe 4, and a heat exchanger heated by the burner, as will be described later. Water supplied from a water supply pipe 2 communicating with the heat exchanger is heated by the heat exchanger, and delivered to a hot water supply pipe 3; a faucet 7 is attached to the distal end of this hot water supply pipe. Operation of the water heater 1 is controlled by a control unit 5, which is an electric unit comprising a CPU.

One of the five water heaters 1 is set to master and the other water heaters 1 are set to slaves. The control unit 5 of the master water heater 1 communicates with the control unit 5 of the slave water heater 1 via the communication line 8, switches operation and stop of the slave water heater 1 for cooperative operation. In the cooperative operation, the control unit 5 of the master water heater 1 changes the number of the slave water heaters 1 performing hot water supply operation cooperatively with the master water heater 1, according to a water supply flow rate from the water supply pipe 2.

Figure 2:
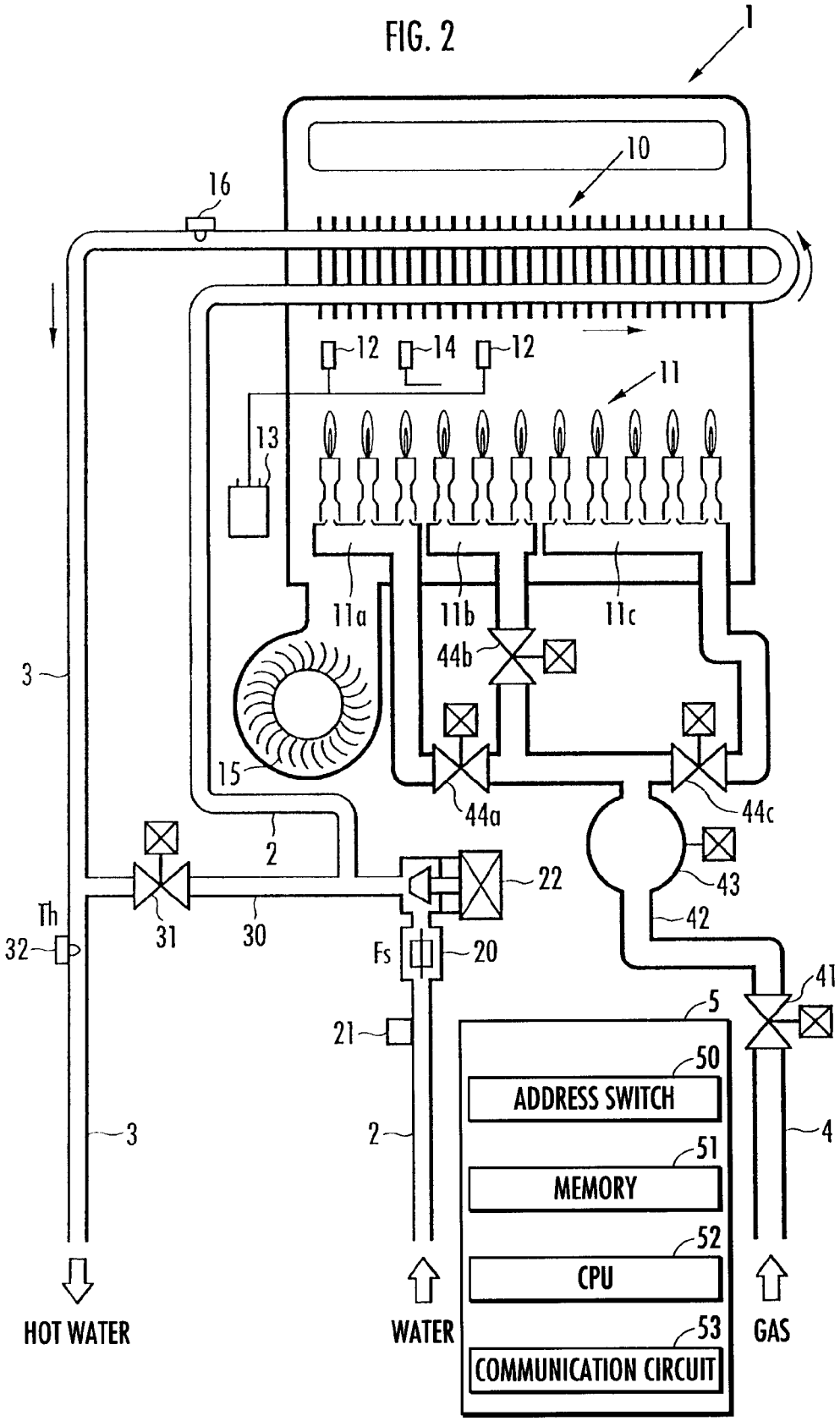
FIG. 2 is a diagram of a configuration of a water heater shown in FIG. 1.
Figure 3:
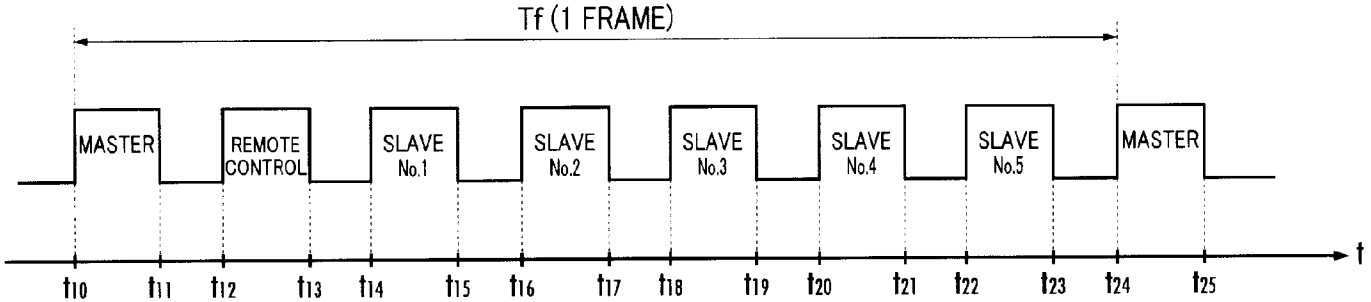
FIG. 3 is a diagram illustrating communication specifications of each water heater and a remote control.
Figure 3:
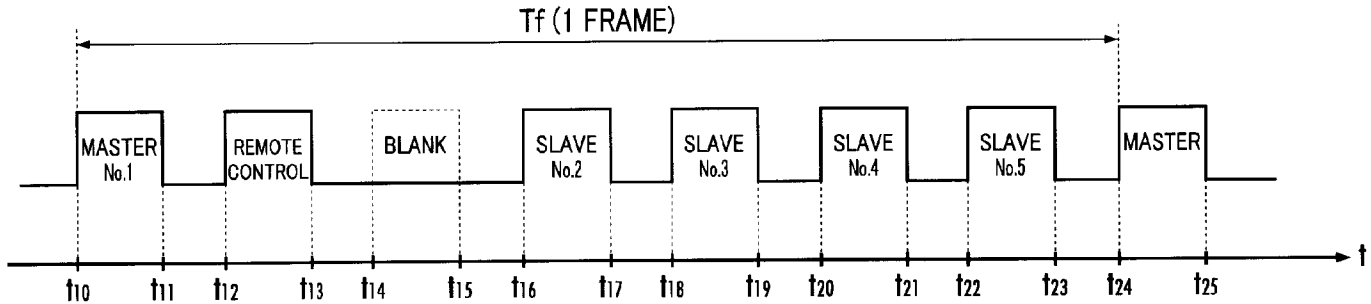

As shown in FIG. 2, each water heater 1 comprises a heat exchanger 10 communicating with the water supply pipe 2 and the hot water supply pipe 3, a burner 11 heating the heat exchanger 10, an ignition plug 12 for igniting the burner 11, an igniter 13 applying a high voltage to the ignition plug 12 to generate a spark discharge, a flame rod 14 detecting a combustion flame of the burner 11, a fan 15 supplying the burner 11 with air for combustion, and a heat exchange temperature sensor 16 detecting a temperature of hot water delivered from the heat exchanger 10. The burner 11 comprises a first burner block 11*a*, a second burner block 11*b* and a third burner block 11*c*.

The water heater 1 further comprises a water supply flow rate sensor 20 detecting a flow rate of water supplied from the water supply pipe 2, a supplied water temperature sensor 21 detecting a temperature of water supplied from the water supply pipe 2, and a water supply servo valve 22 controlling a flow rate of water supplied from the water supply pipe 2.

A bypass pipe 30, which bypasses the heat exchanger 10 and communicates with the water supply pipe 2 and the hot water supply pipe 3, comprises a bypass servo valve 31 controlling a degree of opening of the bypass pipe 30. The hot water supply pipe 3 comprises a hot water supply temperature sensor 32 detecting a temperature of hot water supplied to the hot water supply pipe 3, downstream from a junction with the bypass pipe 30.

The gas supply pipe 4 comprises a main solenoid valve 41 that opens and closes the gas supply pipe 4, a gas proportional valve 43 that controls a degree of opening of a hot water supply gas pipe 42 extending from the gas supply pipe 4, a first switching electromagnetic valve 44*a* that switches supply and shut-off of fuel gas from the hot water supply gas pipe 42 to a first burner block 11*a*, a second switching electromagnetic valve 44*b* that switches supply and shut-off of the fuel gas from the hot water supply gas pipe 42 to a second burner block 11*b*, and a third switching electromagnetic valve 44*c* that switches supply and shut-off of the fuel gas from the hot water supply gas pipe 42 to a third burner block 11*c*.

The control unit 5 comprises an address switch 50 (corresponding to an identification number assigning unit of the present invention, such as a DIP switch) for assigning addresses (corresponding to identification numbers of the present invention) that specify orders of priority to the respective water heaters 1, a memory 51 (corresponding to a storing unit of the present invention), a CPU 52, and a communication circuit 53 for mutual communication with another water heater 1 and the remote control 6 via the communication line 8.

A mutual communication unit of the present invention comprises the communication circuit 53 included in the control unit 5 of each water heater 1, and the communication line 8.

The control unit 5 receives input signals from the flame rod 14, the heat exchange temperature sensor 16, the water supply flow rate sensor 20, the supplied water temperature sensor 21, and the hot water supply temperature sensor 32. Control signals output from the control unit 5 control operations of the igniter 13, the fan 15, the water supply servo valve 22, the bypass servo valve 31, the main solenoid valve 41, the gas proportional valve 43, the first switching electromagnetic valve 44*a*, the second switching electromagnetic valve 44*b*, and the third switching electromagnetic valve 44*c*.

The control unit 5 causes the CPU 52 to execute a program for controlling the water heater 1 that is held on the memory 51, thereby controlling the operation of the water heater 1. The control unit 5 opens the water supply servo valve 22 during the water heater 1 is in an operation state; when the faucet 7 is opened and thus a flow rate of water detected by the water supply flow rate sensor 20 reaches at least a preset ignition flow rate, the control unit 5 opens the main solenoid valve 41, the gas proportional valve 43, the first switching electromagnetic valve 44*a*, the second switching electromagnetic valve 44*b* and the third switching electromagnetic valve 44*c* in a state where the fan 15 supplies the burner 11 with air for combustion and the igniter 13 applies a high voltage to the ignition plug 12 to generate a spark discharge, thereby igniting the burner 11.

The control unit 5 then performs a hot water supply operation for controlling the combustion range of the burner 11 by opening and closing the first switching electromagnetic valve 44*a*, the second switching electromagnetic valve 44*b* and the third switching electromagnetic valve 44*c*, controlling the degree of opening of the gas proportional valve 43 and controlling the rotational speed of the fan 15 such that the temperature of hot water delivered to the hot water supply pipe 3 detected by the hot water supply temperature sensor 32 becomes a hot water supply preset temperature (set by the remote control 6).

When the faucet 7 is closed and the flow rate detected by the water supply flow rate sensor 20 falls below the ignition flow rate, the control unit 5 closes the main solenoid valve 41, the gas proportional valve 43, the first switching electromagnetic valve 44*a*, the second switching electromagnetic valve 44*b* and the third switching electromagnetic valve 44*c* and thus extinguishes the burner 11, thereby finishing the hot water supply operation.

The address switch 50 of the control unit 5 assigns any of the addresses of Nos. 1 to 5 to each water heater 1. The order of priority of addresses is set in ascending order (No. 1 has the highest priority, from which the priority descends with Nos. 2 and 3, and No. 5 has the lowest priority.).

Next, referring to FIG. 3A, timings of transmitting and receiving data in a case where each water heater 1 cooperatively operates will be described.

As shown in FIG. 3A, timings of transmitting response data by each of the master and slave water heaters 1 and the remote control 6 in cooperative operation is set with reference to the response data output from the master water heater 1 in Tf (set to one frame, e.g. about several hundred milliseconds) ($t_{10}$-$t_{11}$: master, $t_{12}$-$t_{13}$: remote control, $t_{14}$-$t_{15}$: slave (address No. 1), $t_{16}$-$t_{17}$: slave (address No. 2), $t_{18}$-$t_{19}$: slave (address No. 3), $t_{20}$-$t_{21}$: slave (address No. 4), $t_{22}$-$t_{23}$: slave (address No. 5)).

When the water heater 1 with the address No. 1 is set to master, the master water heater 1 outputs the response data to the communication line 8 in $t_{10}$-$t_{11}$ and the response time period $t_{14}$-$t_{15}$ becomes blank, as shown in FIG. 3B. In cooperative operation, operations that the master and slave water heaters 1 and the remote control 6 output response data in respective transmission time periods are repeatedly performed with reference to Tf as a control period.

In a case where the water heater 1 with the address No. 1 fails and the water heater 1 with the address No. 2 is set to master, the master water heater 1 (address No. 2) outputs the response data to the communication line 8 in $t_{10}$-$t_{11}$ and thus response time periods $t_{14}$-$t_{15}$ and $t_{16}$-$t_{17}$ become blank.

Here, the response data of the master and slave water heaters 1 includes information shown in following Table 1.

TABLE 1

| Master response data | Slave response data |
|---|---|
| Address of master water heater | Water supply flow rate (without water feeding/low/medium/high) |
| Hot water supply preset temperature | Operation state (stop/operation/error) |
| Operation instruction of slave water heater (address) | Error code |
| Operation state (stop/operation/error) | |

The control unit 5 of each water heater 1 recognizes ranges of the water supply flow rate detected by the water supply flow rate sensor 20 in a manner divided into three stages, or "low", "medium" and "high". The control unit 5 of the master water heater 1 maintains the present number of water heaters 1 in operation during all the water supply flow rate detected by the water supply flow rate sensor 20 of the master water heaters 1 and the water supply flow rates recognized from the response data of the slave water heaters 1 in operation (the water supply servo valve 22 is in an open state) are "medium".

When the hot water supply rate from the faucet 7 decreases and the flow rate of water supply to any of the water heaters 1 in operation becomes "low", the control unit 5 of the master water heater 1 stops any one of the slave water heaters 1 in operation (closes the water supply servo valve 22).

In contrast, when the flow rate of water supply to any of the water heaters 1 in operation increases and becomes "high", the control unit 5 of the master water heater 1 starts to operate one of the stopped slave water heaters 1 (opens the water supply servo valve 22).

The number of the water heaters 1 in operation is thus changed. In order to prevent only some of the water heaters 1 from continuing operation and being degraded, the control unit 5 of the master water heater 1 acquires a cumulative amount of operation time of each water heater 1 and manages the operating slave water heaters 1 in rotation so as to keep the cumulative operation times of the respective water heater 1 substantially uniform.

That is, the control unit 5 of the master water heater 1 controls the water heater 1 with a short cumulative operation time to preferentially operate and, in contrast, the water heater 1 with a long cumulative operation time to be preferentially stopped.

Figure 4:
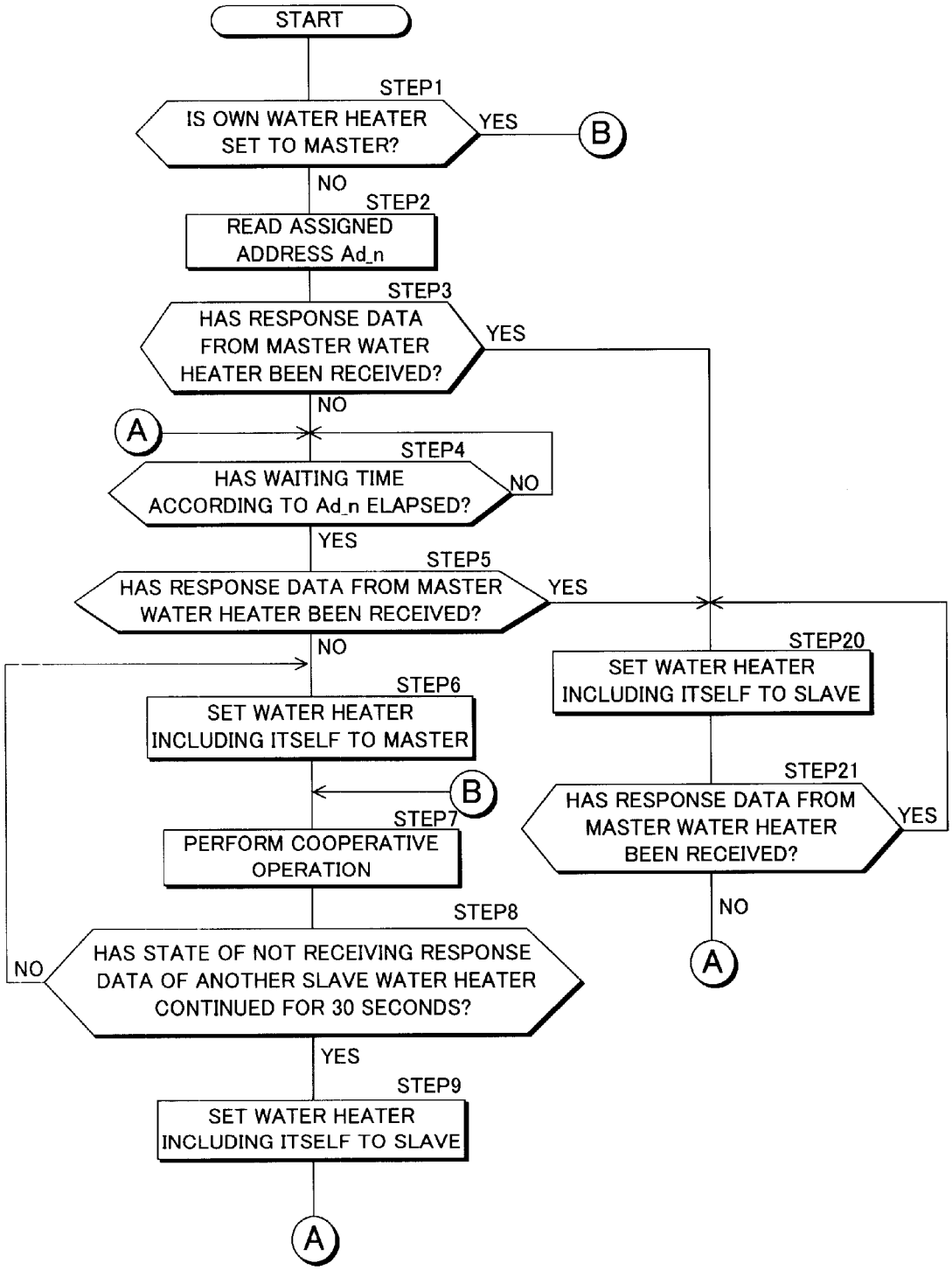
FIG. 4 is a flowchart of processing of setting a master and a slave.

Next, even in case where the master water heater 1 fails, the control unit 5 of each water heater 1 performs a master and slave setting process according to a flowchart shown in FIG. 4 to set a new master, thereby continuing cooperative operation of the water heaters 1. The process will hereinafter be described according to the flowchart shown in FIG. 4.

When the water heater 1 is turned on, the control unit 5 of each water heater 1 causes the CPU 52 to start a control program for the water heater 1 held in the memory 51, thereby starting the process of the flowchart shown in FIG. 4.

In step 1, the control unit 5 determines whether the water heater 1 including itself is set to master or not. If the heater set to master, the processing branches to step 7 and the control unit performs cooperative operation. In this case, the control unit 5 transmits the response data in the response time period $t_{10}$-$t_{ii}$ every period Tf shown in FIG. 3A.

On the other hand, if the water heater 1 including the control unit 5 itself is not set to master, the processing proceeds to step 2 and the control unit 5 reads an address Ad_n (any of Nos. 1 to 5) that is assigned to the water heater 1 including itself by the address switch 50.

In subsequent step 3, the control unit 5 determines whether to have received response data from the master water heater 1 or not. If the response data from the master water heater 1 has been received (in this case, it can be determined that the master water heater 1 is normally operating), the processing branches to step 20 and the control unit 5 sets the water heater 1 including itself to slave and the processing proceeds to step 21.

In step 21, the control unit 5 determines whether to have received the response data from the master water heater 1 or not. If the response data from the master water heater 1 has been received (in this case, it can be determined that the master water heater 1 is normally operating), the processing branches to step 20 and the control unit 5 maintains the water heater 1 including itself to slave.

On the other hand, if it is determined to have not received the response data from the master water heater 1 in step 21 (in this case, it can be determined that the master water heater 1 has not been set, or the water heater 1 having been set to master is in failure and output of the response data is stopped), the processing proceeds to step 4.

In step 4, the control unit 5 waits until a waiting time from startup assigned according to the address of the water heater 1 including itself has elapsed, and then the processing proceeds to step 5. Here, the waiting time is set such that, the higher the priority, the shorter the time is, for instance in a manner where the address No. 1 is set to two seconds, the address No. 2 is set to three seconds, the address No. 3 is set to four seconds, the address No. 4 is set to five seconds, and the address No. 5 is set to six seconds.

Setting of such waiting times allow timing of subsequent step 5 at which each water heater 1 receives the response data from the master water heater 1 to be sooner with priority of the address assigned to the water heater 1. In step 5, the control unit 5 determines whether to have received the response data from the master water heater 1 or not.

If the response data from the master water heater 1 has been received, the processing branches to step 20. If the response data from the master water heater 1 has not been received, the processing proceeds to step 6, the control unit 5 sets the water heater 1 including itself to master and performs cooperative operation in subsequent step 7.

Here, in a case of not receiving the response data from the master water heater 1 in step 5, the control unit 5 can determine that any water heater 1 with a priority higher than that of the address of the water heater 1 including itself does not exist.

More specifically, if a water heater 1 with a high priority exists, the waiting time in step 4 is short and thus processes in steps 5 and 6 are previously executed. Accordingly, the water heater 1 with a high priority is set to master. The water heater 1 set to master starts the cooperative operation in step 7 and transmits the response data.

The control units 5 of the other water heaters 1 that have not been set to master receive the response data in step 5. Accordingly, the water heater 1 assigned with an address with the highest priority among those of the water heaters 1 set to slave, is set to master.

In subsequent step 8, the control unit 5 determines whether a state of not receiving the slave response data from another water heater 1 has continued for 30 seconds or not. If the slave response data from another water heater 1 has thus not been received, it can be determined that another water heater 1 connected to the communication line 8 does not exist.

In this case, the control unit 5 sets the water heater 1 including itself to slave in step 9, the processing proceeds to step 4 and processes in and after step 4 are executed. This allows the water heater 1 assigned with an address with the highest priority to be set to master and perform cooperative operation when another water heater 1 is connected to the communication line 8.

Even in a case where the master water heater 1 is thus changed, the remote control 6 is connected to the communication line 8 and thereby a user can modify the operation conditions of the hot water supply preset temperature of the newly set master water heater 1 by means of operation to the remote control 6.

A time period from the time at which the control unit 5 is activated at turn-on and starts execution of the flowchart of FIG. 4 to the time at which setting on each water heater 1 to master or slave is completed corresponds to a master and slave setting time period of the present invention. The start time of the master and slave setting time period may be determined by for instance broadcast of prescribed data from the remote control 6 to each water heater 1 according to an operation to the remote control 6, instead of by turn-on.

The control unit 5 of each water heater 1 receives the response data output from the remote control 6 to the communication line, and holds on the memory 51 data of operation conditions, such as a hot water supply preset temperature, recognized from the response data. Accordingly, even in a case where any water heater 1 is set to master, the control unit 5 of the water heater 1 set to master reads the operation condition data held on the memory 51 and can thereby take over the previous operation conditions and execute the hot water supply operation.

In this embodiment, even in a case where the master water heater 1 is changed, connection of the remote control 6 to the communication line 8 allows the remote control 6 to subsequently set the operation conditions. However, even without the remote control in such a connection configuration, advantageous effects of the present invention can be attained.

In this embodiment, the control unit 5 of each water heater 1 holds on the memory 51 the operation condition data recognized from the response data transmitted from the remote control 6. However, even in a case without holding such operation condition data, the advantageous effects of the present invention can be attained.

This embodiment exemplifies a case of cooperatively operating the five water heaters. However, the present invention is applicable to a hot water supply system cooperatively operating at least two water heaters. In a hot water supply system cooperatively operating two water heaters, in case where the master water heater 1 fails, the processing of the flowchart of FIG. 4 sets the water heater 1, having previously been set to slave, to master and independently performs the hot water supply operation.

This embodiment exemplifies the hot water supply system including the remote control 6 connected to the communication line 8. However, the present invention is applicable to a hot water supply system without the remote control 6. In this case, operation condition data of cooperative operation is preliminarily be held on the memory 51 of each water heater 1. Accordingly, when the master water heater 1 is changed, the control unit 5 of the water heater 1 newly set to master can take over operation conditions of the hot water supply operation through use of the operation condition data held in its own memory 51.

What is claimed is:

1. A hot water supply system setting one of a plurality of water heaters to master, setting another to slave and cooperatively operating a hot water supply operation, comprising:

an identification number assigning unit which individually assigns an identification number specifying order of priority, to each of the water heaters;

wherein each of the water heaters comprises a control unit, a transmitter configured to transmit prescribed response data to another water heater at a timing according to its own identification number and different from a timing of the other water heater in a prescribed master and slave setting time period, and a receiver configured to receive the response data from the other water heater, the control unit comprises a determination element to determine whether the receiver receives the response data from the other water heater assigned with an identification number having a priority higher than an own identification number in the master and slave setting time period; and a setting element configured to set the water heater itself to slave if a determination by the determination element is positive and to set the water heater itself to master if a determination by the determination element is negative.

2. The hot water supply system according to claim 1, wherein each of the water heaters comprises a storing unit which holds operation condition data of the hot water supply operation, and the water heater set to master performs the hot water supply operation using the operation condition data held in its own storing unit.

3. A hot water supply system setting one of a plurality of water heaters to master, setting another to slave and cooperatively operating a hot water supply operation, comprising:

an identification number assigning unit which assigns a unique identification number specifying order of priority, to each of the water heaters;

a mutual communication unit which connects and allows the plurality of water heaters to communicate with each other;

a plurality of control units, each of which is provided in a different one of the plurality of water heaters, and each of which is configured to perform a master and slave setting process; and a remote control which is connected to and capable of communicating with each of the water heaters via the mutual communication unit, wherein the master and slave setting process includes transmitting prescribed response data to the other water heater via the mutual communication unit at a timing according to its own identification number and different from the timing of the other water heater in a prescribed master and slave setting time period, setting the water heater itself to slave in a case of receiving the response data from another water heater assigned with an identification number having a priority higher than its own identification number in the master and slave setting time period, and setting the water heater itself to master in a case of not receiving the response data from another water heater assigned with an identification number having a priority higher than its own identification number in the master and slave setting time period, and wherein the remote control remotely operates the water heater set to master by means of communication via the mutual communication unit.

4. The hot water supply system according to claim 3, wherein each of the water heaters receives operation condition data of the hot water supply operation transmitted from the remote control via the mutual communication unit and stores the data in a storing unit included in each of the water heaters, and the water heater set to master performs the hot water supply operation using the operation condition data held in its own storing unit.

5. A method for setting one of a plurality of water heaters to master and setting another to slave, comprising:

assigning an identification number specifying an order of priority to each of the water heaters using an identification number assigning unit; and causing each of the water heaters to:

transmit prescribed response data to another water heater at a timing according to its own identification number and different from a timing of the other water heater in a prescribed master and slave setting period using a transmitter provided in the water heater;

receive response data from the other water using a receiver provided in the water heater;

determine whether the receiver receives the response data from the other water heater assigned with an identification number having a priority higher than an own identification number in the master and slave setting time period using a determination element; and set the water heater itself to slave if a determination by the determination element is positive, and set the water heater itself to master if a determination by the determination element is negative using a setting element.

* * * * *